US009777459B2

(12) United States Patent
Zuritis

(10) Patent No.: US 9,777,459 B2
(45) Date of Patent: Oct. 3, 2017

(54) ATTACHMENT FOR A SKID STEER LOADER AND METHOD OF USE THEREOF

(75) Inventor: Michael Zuritis, Ballston Lake, NY (US)

(73) Assignee: SOLAR FOUNDATIONS USA, INC, Newark, DE (US)

( * ) Notice: Subject to any disclaimer, the term of this patent is extended or adjusted under 35 U.S.C. 154(b) by 538 days.

(21) Appl. No.: 13/562,897

(22) Filed: Jul. 31, 2012

(65) Prior Publication Data

US 2014/0037415 A1 Feb. 6, 2014

(51) Int. Cl.

| | |
|---|---|
| ***E21B 7/02*** | (2006.01) |
| ***E02F 3/42*** | (2006.01) |
| ***E02F 3/06*** | (2006.01) |
| ***E02F 3/34*** | (2006.01) |

(52) U.S. Cl.

CPC ..... *E02F 3/42* (2013.01); *E02F 3/06* (2013.01); *E02F 3/3414* (2013.01); *Y10T 29/49826* (2015.01)

(58) Field of Classification Search

CPC ..... B60P 1/5433; B66C 13/18; E02F 3/307; E02F 3/3604; E02F 3/3677; E02F 3/3681; E02F 3/384; E02F 9/123; E21B 7/026

USPC ..... 173/184, 185, 189

See application file for complete search history.

(56) References Cited

U.S. PATENT DOCUMENTS 2,698,697 A 1/1955 Holopainen
2,750,155 A * 6/1956 Nixon ..... 182/2.7
2,903,949 A * 9/1959 Simmonds ..... 173/194
3,030,713 A 4/1962 Hendrickson et al.
3,042,236 A 7/1962 Pilch
3,227,295 A * 1/1966 Hamilton ..... A01G 23/006 144/4.1
3,289,779 A * 12/1966 Feucht ..... B62D 55/116 180/41
3,500,938 A * 3/1970 Watson ..... E21B 7/021 173/189
3,645,343 A * 2/1972 Mays ..... 173/195
3,746,193 A * 7/1973 Eaves ..... B66C 1/585 212/261
3,766,952 A * 10/1973 Boers ..... A01G 23/087 144/34.1
3,842,610 A * 10/1974 Willis et al. ..... 405/302.1
3,888,317 A * 6/1975 Walters ..... 173/193
3,922,745 A * 12/1975 Lehman ..... E01H 1/053 15/21.1

(Continued)

*Primary Examiner* — Robert Long
(74) *Attorney, Agent, or Firm* — Schmeiser, Olsen & Watts, LLP

(57) ABSTRACT

Disclosed herein is an attachment and vehicle that includes a left loader arm, a right loader arm, and a boom arm operatively attached to the left loader arm and the right loader arm. The boom arm extends in substantially the same direction that both the left loader arm and the right loader arm extends, is positioned between the left loader arm and the right loader arm, and includes a rotating mechanism at a first end for attaching and rotating a vertical column for installation in the ground. The attachment includes a first hydraulic cylinder attaching the left loader arm with the boom arm and a second hydraulic cylinder attaching the right loader arm with the boom arm. The first and second hydraulic cylinders exact rotation on the boom arm, and the first and second hydraulic cylinders extend at least substantially perpendicular to the plane of rotation of the boom arm.

17 Claims, 9 Drawing Sheets

(56) References Cited

U.S. PATENT DOCUMENTS 3,933,261 A * 1/1976 Marostica ..... B66C 23/44 414/23
3,961,469 A * 6/1976 McRobert ..... 56/328.1
4,005,905 A * 2/1977 Dubois ..... E21D 9/106 299/31
4,007,845 A 2/1977 Worback
4,065,010 A 12/1977 Worback
4,067,398 A * 1/1978 Franzen ..... E21B 19/081 173/193
4,088,289 A * 5/1978 Wood et al. ..... 248/647
4,139,067 A * 2/1979 Craig ..... A01G 17/16 173/100
4,181,182 A * 1/1980 Gustafsson ..... E21B 7/025 173/189
4,199,033 A * 4/1980 Van Gundy, Jr. ..... E02F 3/3677 173/192
4,260,290 A * 4/1981 Flippin ..... E02F 5/103 172/40
4,264,051 A * 4/1981 Walmsley et al. ..... 248/660
4,284,368 A * 8/1981 Albright ..... E21D 15/00 173/38
4,308,923 A * 1/1982 Gilbert ..... E21B 7/005 173/193
4,368,602 A * 1/1983 Manten ..... 52/115
4,445,663 A * 5/1984 Goyarts ..... E21B 7/02 248/371
4,446,930 A * 5/1984 Nilsson ..... B25D 17/08 173/132
4,461,369 A * 7/1984 Amador ..... E01D 19/106 182/2.6
4,465,425 A * 8/1984 Schwappach ..... B66C 23/54 414/550
4,500,250 A 2/1985 Maurer et al.
4,578,008 A * 3/1986 Gleason ..... A01D 87/127 414/24.5
4,602,462 A * 7/1986 Anderson ..... B66F 11/044 182/2.9
4,744,303 A * 5/1988 Pasquini ..... E01B 27/16 104/12
4,785,892 A * 11/1988 Luen ..... E02D 7/16 173/28
4,799,850 A 1/1989 Petitto, Sr. et al.
4,828,044 A * 5/1989 Horsch ..... E02F 3/80 172/821
4,893,683 A * 1/1990 Horsch ..... E02F 3/80 172/821
4,924,610 A * 5/1990 Sodemann ..... E01H 5/06 37/231
4,940,203 A * 7/1990 Hayakawa ..... F16M 11/36 135/84
4,960,359 A 10/1990 Lovitt, Jr.
5,060,735 A * 10/1991 .ANG.gren ..... 175/40
5,073,080 A * 12/1991 Blum ..... E02F 3/962 294/115
5,120,186 A 6/1992 Jorgenson
5,269,107 A * 12/1993 Klemm ..... 52/115
5,292,220 A 3/1994 Cartner
5,310,011 A * 5/1994 Kaakkurivaara ..... E21B 15/04 173/194
5,507,354 A * 4/1996 Harleman ..... E21B 19/087 173/185
5,647,722 A 7/1997 Cartner
5,661,917 A 9/1997 Marchetta et al.
5,803,550 A * 9/1998 Watson et al. ..... 299/13
5,819,445 A * 10/1998 LaBelle ..... E02F 3/3677 172/817
5,934,147 A 8/1999 Parker
5,934,387 A * 8/1999 Tuunanen ..... 175/45
5,954,143 A * 9/1999 McCabe et al. ..... 173/184
6,035,784 A * 3/2000 Watson ..... 102/313
6,220,292 B1 * 4/2001 Woodling ..... B66C 23/42 137/355.16
6,460,652 B1 * 10/2002 Piipponen ..... 182/2.9
6,520,731 B2 2/2003 MacLeod
6,666,125 B2 * 12/2003 Gunzenhauser ..... E02F 3/02 60/469
6,921,241 B2 * 7/2005 Rogers ..... A01G 23/003 212/255
7,100,350 B2 * 9/2006 Breneur ..... A01D 78/1007 172/481
7,387,173 B2 * 6/2008 Jinnings et al. ..... 173/184
7,575,398 B2 * 8/2009 Lloyd ..... E02D 11/00 173/183
7,878,750 B2 * 2/2011 Zhou ..... B25J 5/007 414/498
8,069,592 B2 * 12/2011 Ellett ..... B66C 23/44 37/406
8,225,537 B2 * 7/2012 Scruggs ..... A61G 17/02 37/300
8,413,353 B2 * 4/2013 Wagger ..... E01H 4/02 37/223
2003/0047359 A1 * 3/2003 Shupe ..... 175/220
2006/0171797 A1 * 8/2006 Hedley ..... B66C 23/48 414/482
2006/0288681 A1 * 12/2006 Kuzub ..... A01D 34/86 56/14.9
2007/0130806 A1 * 6/2007 Goodman ..... B66F 9/065 37/234
2008/0190633 A1 * 8/2008 Johnston ..... E02F 3/966 173/184
2010/0012340 A1 * 1/2010 Kuosmanen ..... 173/184
2010/0170974 A1 * 7/2010 Muraoka ..... E02F 3/3654 241/203
2011/0036608 A1 * 2/2011 Nystrom ..... E21D 20/003 173/185
2013/0149091 A1 * 6/2013 Friggstad ..... B60P 1/36 414/523

* cited by examiner

ATTACHMENT FOR A SKID STEER LOADER AND METHOD OF USE THEREOF

FIELD OF TECHNOLOGY

The subject matter disclosed herein relates generally to vertical column or pile installation. More particularly, the subject matter relates to an attachment for a skid steer loader for installation of vertical columns or piles, and a method of use thereof.

BACKGROUND

Vertical piles or columns are often installed into the ground as supports for various structures including but not limited to solar arrays. These vertical piles must be installed at precise locations in the ground in order to properly construct the solar array foundations. These vertical piles are typically installed with heavy machinery which drives the piles into the ground. These machines must be moved into and remain in the exact location that the pile should be driven into the ground. Alternately, large holes must be dug by excavating equipment in order to ensure that the piles are in the proper location before back filling or cementing. For this reason, it is often a difficult, time consuming, and costly process for installing vertical piles into the ground.

Thus, an attachment for a skid steer loader for installation of vertical columns or piles, and a method of use thereof, would be well received in the art.

SUMMARY

According to a first described aspect an attachment for a loader vehicle comprises: a left loader arm; a right loader arm; a boom arm operatively attached to the left loader arm and the right loader arm, wherein the boom arm extends in the same or substantially the same direction that both the left loader arm and the right loader arm extends, wherein the boom arm is positioned between the left loader arm and the right loader arm, and wherein the boom arm includes a rotating mechanism at a first end for attaching and rotating a vertical column for installation in the ground; a first hydraulic cylinder attaching the left loader arm with the boom arm; and a second hydraulic cylinder attaching the right loader arm with the boom arm; wherein the first and second hydraulic cylinders are configured to exact rotation on the boom arm, and wherein the first and second hydraulic cylinders extend at least substantially perpendicular to the plane of rotation of the boom arm.

According to a second described aspect, an attachment for a loader vehicle comprises: a left loader arm; a right loader arm; a first hydraulic cylinder extending substantially vertically from the left arm; a second hydraulic cylinder extending substantially vertically from the right arm; a base portion attached to the left arm and the right arm; and a boom arm attached to the first and second hydraulic cylinders at a first location along a length of the boom arm and attached to the base portion at a second location along the length, wherein the boom arm extends in the same or substantially the same direction that the left and right loader arms extend, wherein the boom arm is positioned between the left loader arm and the right loader arm, and wherein the first and second hydraulic cylinders exact the rotation about the second location, wherein the boom arm includes a rotating mechanism at a first end for attaching and rotating a vertical column for installation in the ground.

According to a third described aspect a loader vehicle comprises: a left loader arm and a right loader arm configured to be raised and lowered; a boom arm operatively attached to the left loader arm and the right loader arm, wherein the boom arm extends in the same or substantially the same direction that both the left loader arm and the right loader arm extends, wherein the boom arm is positioned between the left loader arm and the right loader arm, and wherein the boom arm includes a rotating mechanism at a first end for attaching and rotating a vertical column for installation in the ground; a first hydraulic cylinder attaching the left loader arm with the boom arm; and a second hydraulic cylinder attaching the right loader arm with the boom arm; wherein the first and second hydraulic cylinders are configured to exact rotation on the boom arm, and wherein the first and second hydraulic cylinders extend at least substantially perpendicular to the plane of rotation of the boom arm.

According to a fourth described aspect, a method of installing vertical piles comprises: providing a vertical loader including: a left loader arm; a right loader arm; a boom arm operatively attached to the left loader arm and the right loader arm, wherein the boom arm extends in the same or substantially the same direction that both the left loader arm and the right loader arm extends, wherein the boom arm is positioned between the left loader arm and the right loader arm, and wherein the boom arm includes a rotating mechanism at a first end for attaching and rotating a vertical column for installation in the ground; a first hydraulic cylinder attaching the left loader arm with the boom arm; and a second hydraulic cylinder attaching the right loader arm with the boom arm, wherein the first and second hydraulic cylinders are configured to exact rotation on the boom arm, and wherein the first and second hydraulic cylinders extend at least substantially perpendicular to the plane of rotation of the boom arm; attaching a vertical column to the end of the boom arm; rotating the boom arm with the hydraulic cylinders; and applying a constant downward pressure on the vertical column by the boom arm.

BRIEF DESCRIPTION OF THE DRAWINGS

The subject matter disclosed herein is distinctly claimed in the claims at the conclusion of the specification. The foregoing and other features and advantages are apparent from the following detailed description taken in conjunction with the accompanying drawings in which:

DETAILED DESCRIPTION

A detailed description of the hereinafter described embodiments of the disclosed apparatus and method are presented herein by way of exemplification and not limitation with reference to the Figures.

Figure 1:
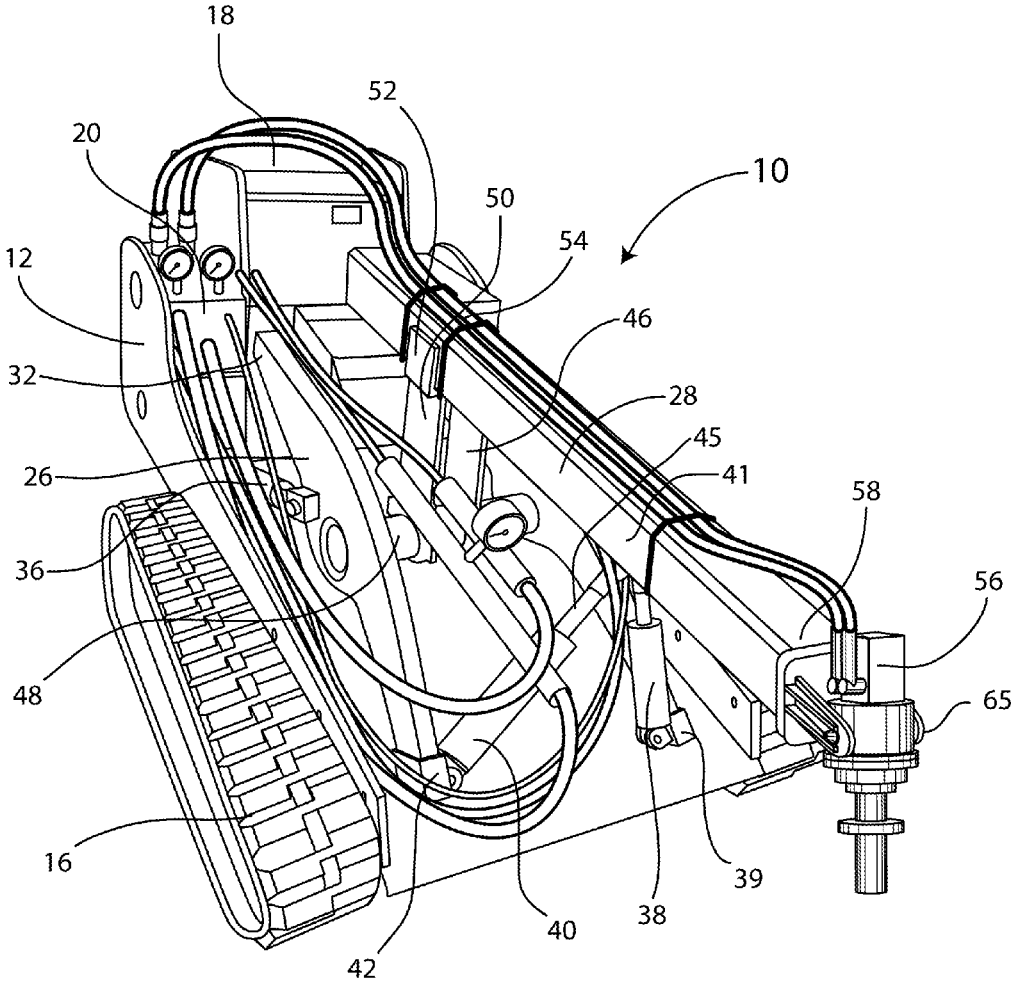
FIG. 1 depicts a perspective view of a loader vehicle according to one embodiment.
Figure 2:
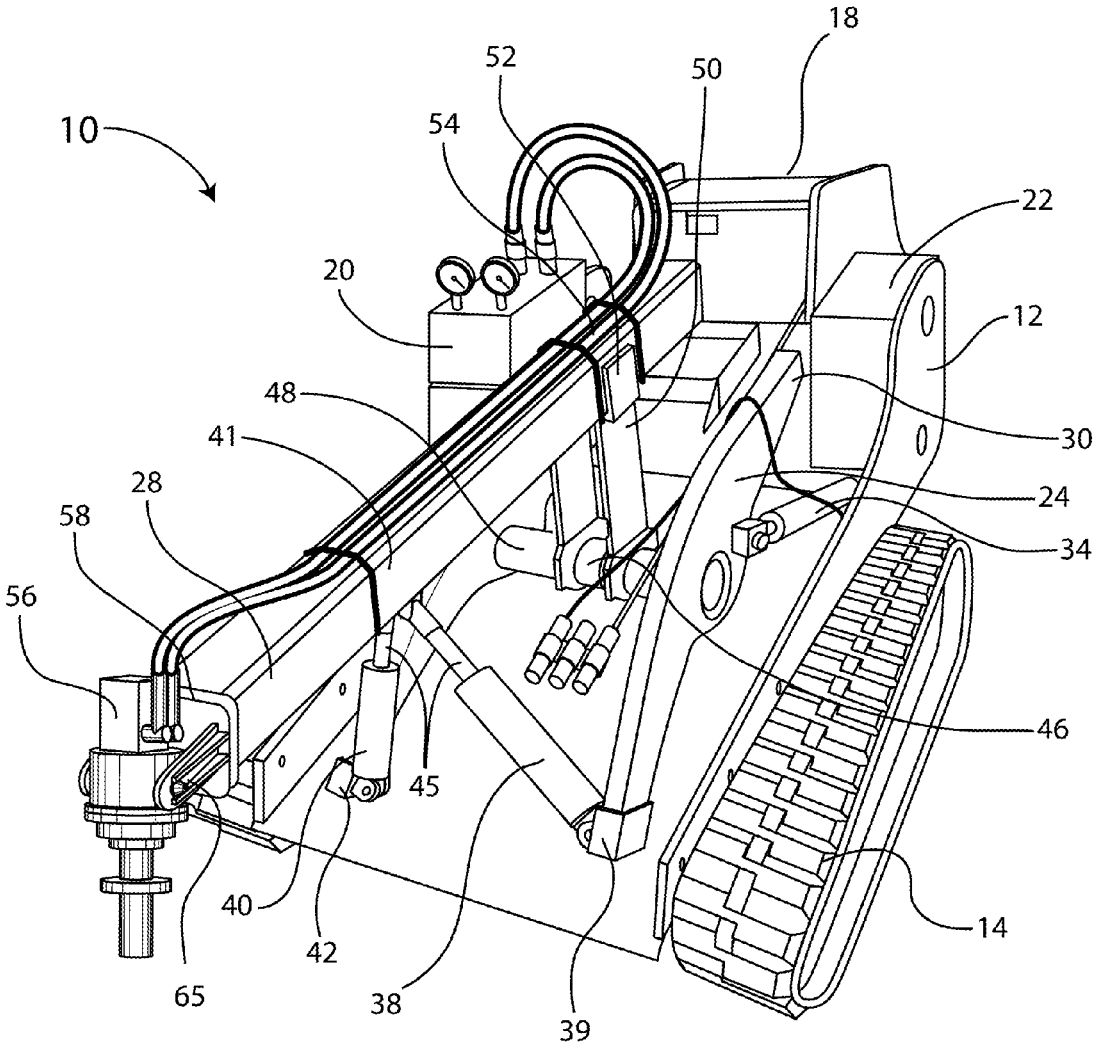
FIG. 2 depicts another perspective view of the loader vehicle of FIG. 1.

Referring firstly to FIGS. 1-2, a perspective view of a loader vehicle 10 is shown according to one embodiment having a main body 12. The loader vehicle 10 may be a skid steer loader as depicted in the embodiment shown. However, it should be understood that the loader vehicle 10 may be any type of vehicle that has loader arms such as a bulldozer, tractor, excavator, bucket loader, front loader, front end loader, payloader, scoop loader, shovel, skip loader, and wheel loader. The loader vehicle 10 is shown having a left track 14 and a right track 16 that may be rotated independently in order to exact motion and turning on the loader vehicle 10. In other embodiments, the loader vehicle 10 may also have four or more wheels to exact motion in another embodiment.

The loader vehicle 10 is shown having the main body 12. The main body 12 may house the engine (not shown), the tracks 14, 16, a driver operating position 18, a hydraulic system 20, and an electronic system 22. The hydraulic system 20 may be configured to control various hydraulic cylinders described herein. The electronic system 22 may be in communication with a remote controlling mechanism 70 (described hereinbelow) that operates the various features described herein. The main body 12 may also include a left loader arm 24 and a right loader arm 26 and a boom arm 28. The left, right and boom arms 24, 26, 28 may, in one embodiment, be an integral component of the loader vehicle 10 as sold by the manufacturer. It should be understood that any or all of the parts described may be an integral component of the loader. In other embodiments, the loader arms 24, 26, 28 may be an attachment system 100 (shown in FIGS. 5-9*c*) that may be attached and/or removed from the loader vehicle 10.

The left loader arm 24 and the right loader arm 26 may be attached to the main body 12 at attachment locations 30, 32. The left loader arm 24 and the right loader arm 26 may be raised and lowered by loader arm hydraulic cylinders 34, 36. The loader arms 24, 26 may be configured to be raised and lowered in unison. In other words, the hydraulic cylinders 34, 36 may not be configured to operate independently but rather may work together to raise and lower each arm 24, 26 at the same rate. The maximum and minimum height achievable by the loader arms 24, 26 may vary from embodiment to embodiment depending on, for example, the mechanical dimensions of the loader arms 24, 26 and the maximum length of the hydraulic cylinders 34, 36.

The boom arm 28 may be operatively attached to the left loader arm 24 and the right loader arm 26 such that it is raised or lowered with the left loader arm 24 and the right loader arm 26. A first boom arm hydraulic cylinder 38 may be attached at or near an end 39 of the left loader arm 24 and extends to a first location 41 along the length of the boom arm 28. Likewise, a second boom arm hydraulic cylinder 40 may be attached to an end 42 of the right loader arm 26 and also extends to the first location 41 along the length of the boom arm 28. The boom arm 28 may include a coupling foundation 44 that includes two extending parallel plates with holes for receiving two bolts (not shown) that are configured to secure the first and second hydraulic cylinders 38, 40 to the boom arm 28. The hydraulic cylinders 38, 40 may each include a rod portion 45 having an eye opening at the end for aligning with the openings of the parallel plates of the coupling foundation 44 and receiving the bolts to secure the hydraulic cylinders 38, 40 to the boom arm 28. In this way, the securing of the hydraulic cylinders 38, 40 may allow for some rotational movement of the hydraulic cylinders 38, 40 about the coupling foundation 44.

The boom arm 28 may also be secured to the loader arms 24, 26 by a base portion 46. The base portion 46 may be attached to the left loader arm 24 and the right loader arm 26. The base portion 46 may include a shaft 48, rod or beam that extends from the left loader arm 24 to the right loader arm 26. The shaft 48 may be an integral portion of the loader vehicle 10 in one embodiment. The base portion 46 may also include a supporting structure 50 extending upwards from the shaft 48 to the boom arm 28. The supporting structure 50 may be welded to the shaft 48 or may be attached to the shaft 48 by any securing means. The base portion 46 may include a rotatable attachment end 52 for attaching to the boom arm 28. The rotatable attachment end 52 may be rotatably attached to the supporting structure 50. The supporting structure 50 of the base portion 46 may be securably or permanently attached to a second location 54 along the length of the boom arm 28. The boom arm 28 may be permitted to rotate about the second location 54. The rotation of the boom arm 28 may be provided about a pin 50*a*. The rotatable attachment end 52, and therefore the entire boom arm 28, is configured to rotate about the pin 50*a* at the pivot second location 54. The boom arm 28 may extend in the same or substantially the same direction that both the left loader arm 34 and the right loader arm 36 extends. The boom arm 28 may also be positioned between the left loader arm 34 and the right loader arm 36.

Figures 7A, 7B, 7C:
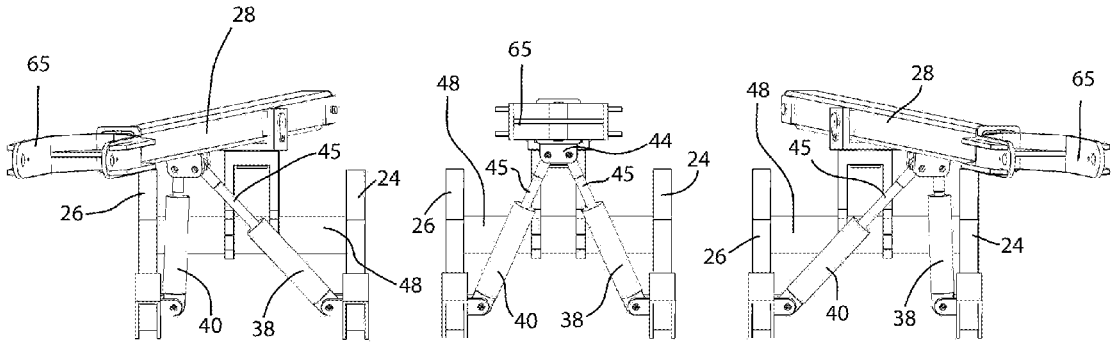
FIG. 7*a* depicts a front view of the attachment of FIGS. 5-7 at a leftmost position according to one embodiment.
FIG. 7*b* depicts a front view of the attachment of FIGS. 5-6 at a midpoint position according to one embodiment.
FIG. 7*c* depicts a front view of the attachment of FIGS. 5-8 at a rightmost position according to one embodiment.
Figures 8A, 8B, 8C:
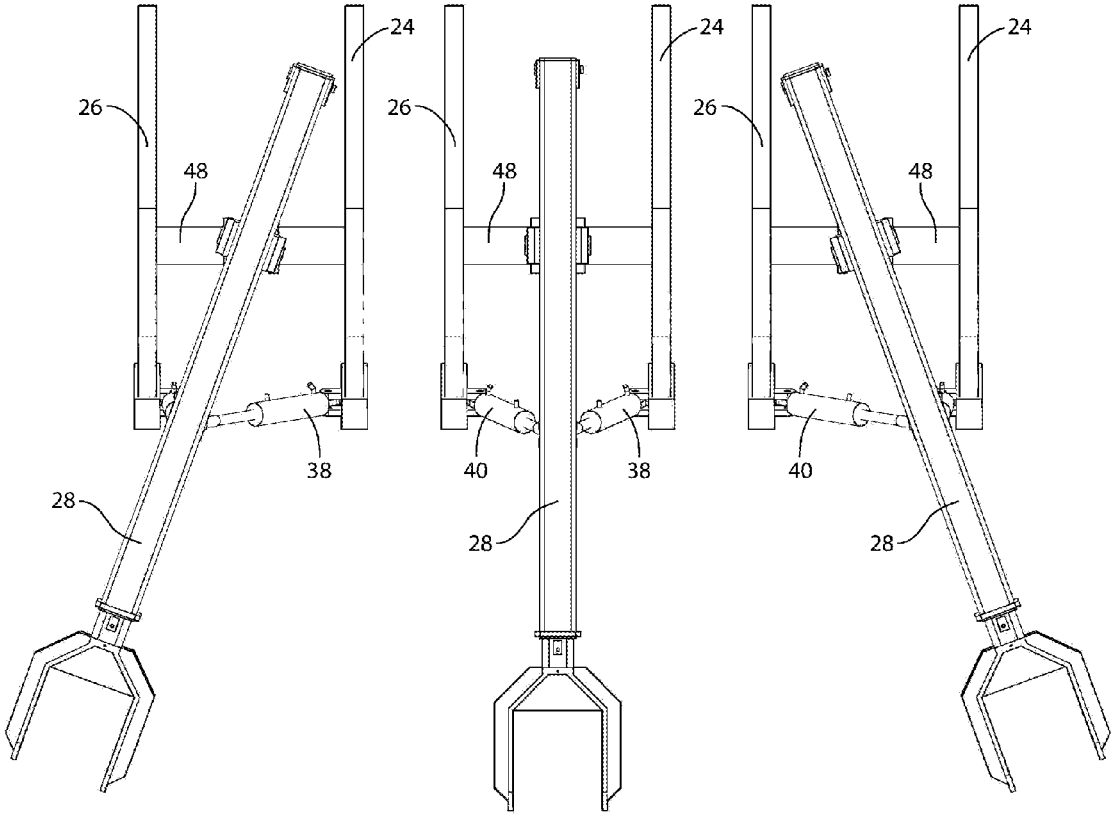
FIG. 8*a* depicts a top view of the attachment of FIGS. 5-7 at a leftmost position according to one embodiment.
FIG. 8*b* depicts a top view of the attachment of FIGS. 5-7 at a midpoint position according to one embodiment.
FIG. 8*c* depicts a top view of the attachment of FIGS. 5-7 at a rightmost position according to one embodiment.

Referring now to FIGS. 7*a*-8*c*, the first and second hydraulic cylinders 38, 40 may be configured to exact this rotation on the boom arm 28 about the second location 54. The first and second hydraulic cylinders 38, 40 may be configured to exact rotation on the boom arm 28 by moving a first end 58 of the boom arm 28 in a left direction to a leftmost position. The leftmost position is shown in FIG. 7*a* in a front view and FIG. 8*a* in a top view. The first and second hydraulic cylinders 38, 40 likewise may be configured to exact rotation on the boom arm 28 by moving the first end 58 of the boom arm 28 in a right direction to a rightmost position which is shown in FIGS. 7*c* and 8*c*. It should be understood that the first hydraulic cylinder 38 extends and the second hydraulic cylinder 40 retracts when the first end 58 of the boom arm 28 is moved in the left direction (shown in FIGS. 7*a* and 8*a*). Likewise, the first hydraulic cylinder 38 retracts and the second hydraulic cylinder 40 extends when the first end 58 of the boom arm 28 is moved in the right direction (shown in FIGS. 7*c* and 8*c*).

Figure 9A:
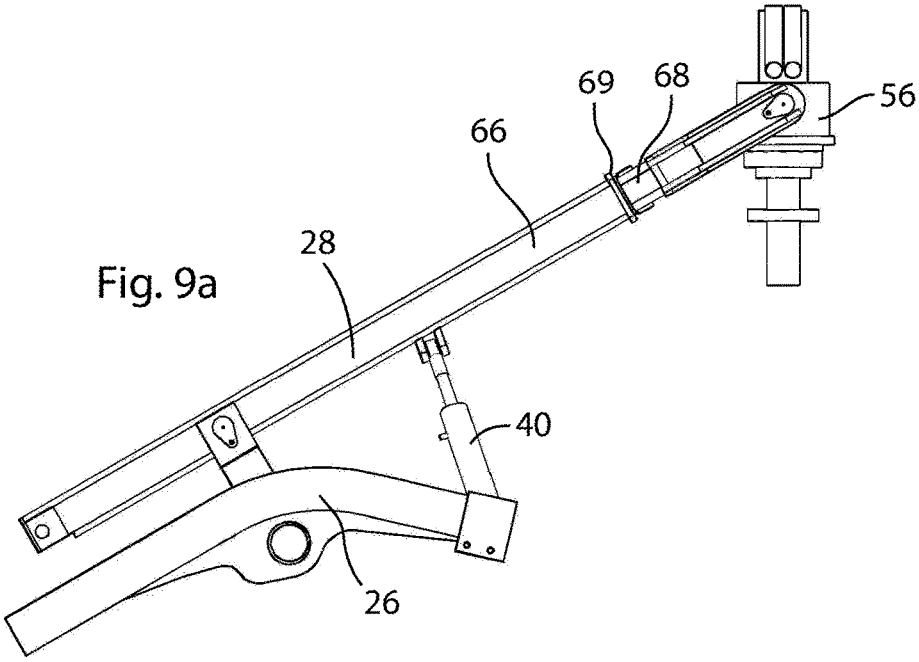
FIG. 9*a* depicts a side view of the attachment of FIGS. 5-8 in a raised position according to one embodiment.
Figure 9B:
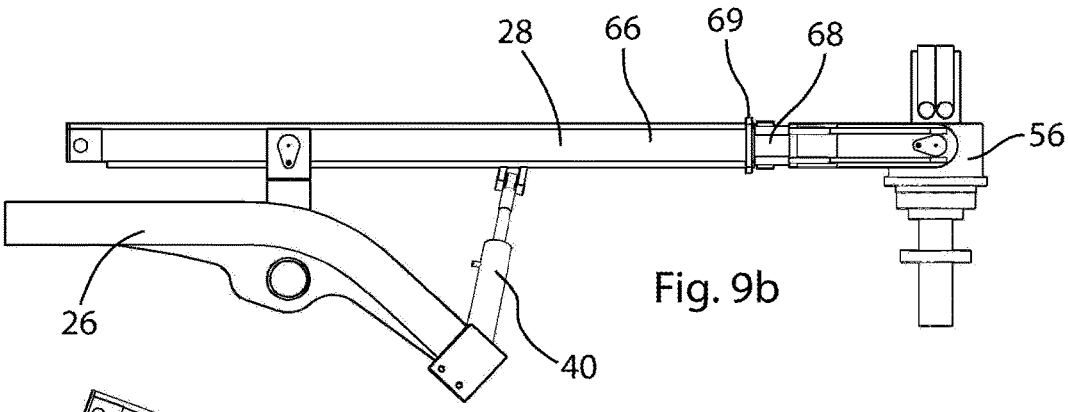
FIG. 9*b* depicts a side view of the attachment of FIGS. 5-8 in a parallel position with the ground according to one embodiment.
Figure 9C:
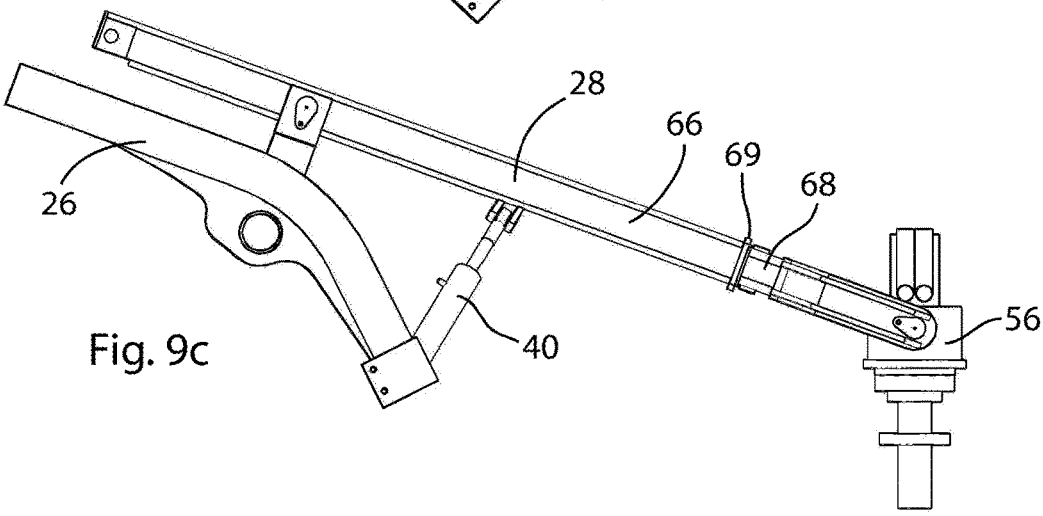
FIG. 9*c* depicts a side view of the attachment of FIGS. 5-8 in a lowered position according to one embodiment.

The first and second hydraulic cylinders 38, 40 may both extend substantially perpendicular upwards. "Substantially perpendicular upwards" is defined herein to mean that the first and hydraulic cylinders, on average, extend upwards at least at a 45 degree angle from the ground when viewed from both the side (as shown in FIGS. 9*a*-9*c*) and front (as shown in FIGS. 7*a*-7*c*) when the boom arm 28 is parallel with the ground (as shown in FIG. 9*b*). For example, when the boom arm 28 is moved to the leftmost or rightmost position, the average angle will be greater than 45 degrees even if a single angle of one of the hydraulic cylinders 38, 40 drops below 45 degrees. In the embodiment depicted in the Figures, the first and second hydraulic cylinders 38, 40 also extend substantially perpendicular to the plane of rotation of the boom arm 28 when the boom arm rotates about the second location 54.

The substantially perpendicular nature of the first and second hydraulic cylinders 38, 40 may permit the boom arm 28 to move in an arc over the ground 62 such that the boom arm 28 is closest to the ground 62 in the leftmost and rightmost positions (shown in FIGS. 7*a*, 8*a* and 7*c*, 8*c*), and farthest from the ground in a midpoint position between the leftmost and rightmost positions (shown in FIGS. 7*b* and 8*b*). This arc is displayed by the front view shown in FIGS. 7*a*-7*c*. The movement provided by the hydraulic cylinders 38, 40 may allow the boom arm 28 to position itself in the precise location necessary without requiring the entire loader vehicle 10 from being positioned as precisely. The substantially perpendicular nature of the first and second hydraulic cylinders 38, 40 may also permit the first and second hydraulic cylinders 38, 40 to structurally support the boom arm 28 at the first location 40 along its length, reducing the stress that would otherwise be found on the second location 54.

The left loader arm 24 and the right loader arm 26 may be configured to raise and fall simultaneously in order to lift and lower the boom arm 28. As previously described, the hydraulic cylinders 34, 36 may extend or retract in order to raise and lower the left loader arm 24 and the right lower arm 26. FIGS. 9*a*-9*c* show maximum and minimum heights of the boom arm 28, according to a non-limiting embodiment. Although FIGS. 9*a*-9*c* do not show the cylinders 34, 36 or the rest of the main body 12 of the loader vehicle 10, it should be understood that the cylinders 34, 36 may exact the motion of the boom arm 28 to the angles shown in FIGS. 9*a*-9*c*.

Figure 3:
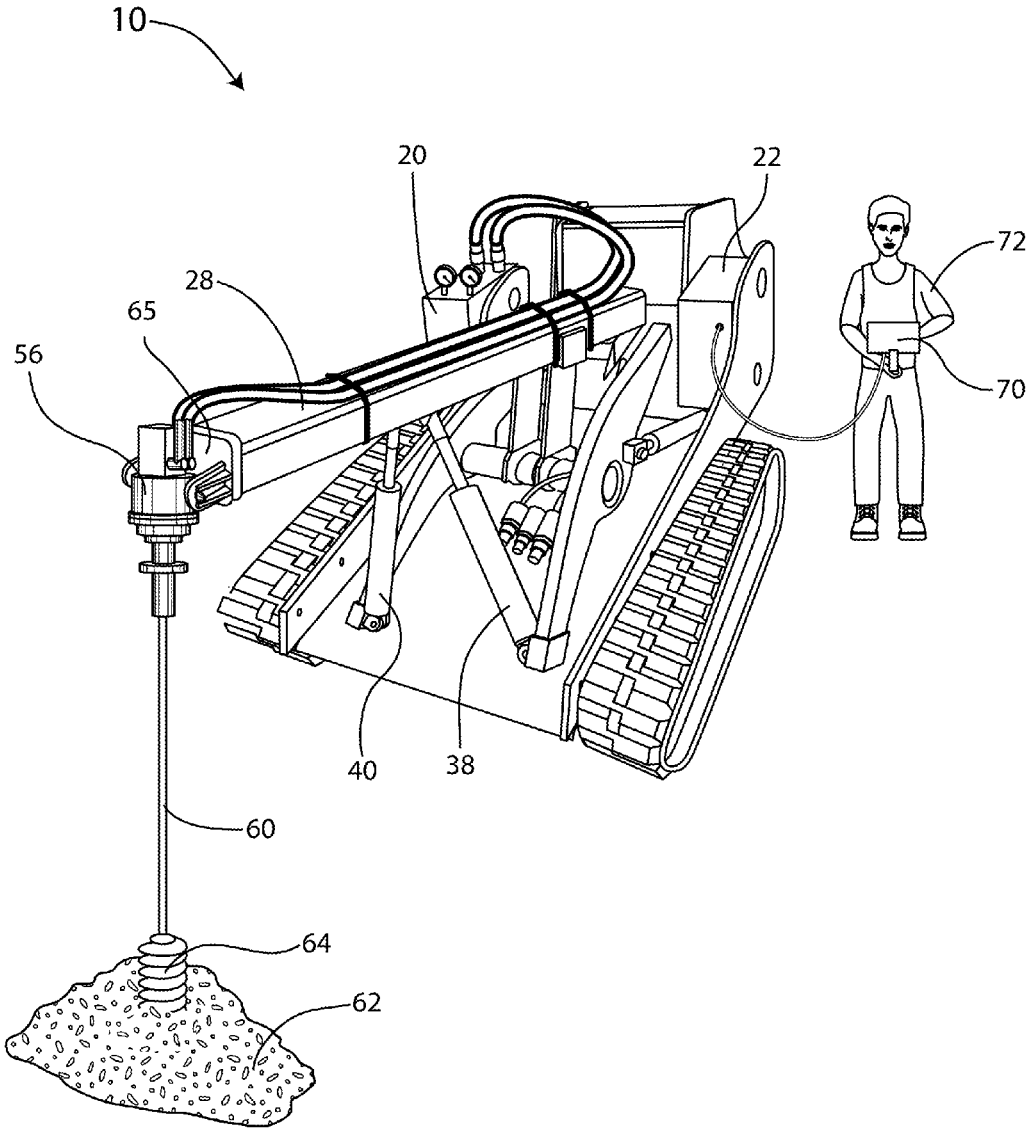
FIG. 3 depicts a perspective view the loader vehicle of FIGS. 1-2 in use by an operator installing a vertical pile.

The boom arm 28 may further include a rotating mechanism 56 at the first end 58 for attaching and rotating a vertical column 60 for installation in the ground 62. The rotating mechanism 56 may be configured to attachably and detatchably receive the vertical column 60 as shown in FIG. 3. It should be understood that the vertical column 60 may also be a pile, stanchion, post, beam, shaft, stud or the like. Embodiments contemplated may be applicable to the installation of any vertical members. The rotating mechanism 56 may be configured to rotate the vertical column 60 in the event that the vertical column 60 includes a helical end 64 for installation into the ground 62. The rotating mechanism 56 at the first end 58 of the boom arm 28 may further be attached to the boom arm 28 by a motor yoke 65 that is rotatable in multiple axes. As shown in FIGS. 9*a*-9*c*, the yoke 65 may provide for rotation in order to accommodate the lifting and the lowering of the loader arms 24, 26 in order to ensure that the column remains in a vertical orientation during installation in the ground 62. Furthermore, the yoke 65 may be configured to rotate about an axis that is parallel with the boom arm 28. This may allow the yoke 65 to rotate about a point on the ground 62 that the vertical column 60 is penetrating as the boom arm 28 is rotated to the left and the right.

In another embodiment (not shown), rather than a rotating mechanism 56, the boom arm 28 may instead include a driving mechanism. The driving mechanism may install vertical columns, such as the vertical column 60, by driving the vertical column into the ground without rotation. It should be understood that the concepts of the present invention may be applied to any particular attachment head, not limited to column installation. Hereinafter, the embodiments described will include the rotating mechanism 56. However, this embodiment is focused on solely for exemplary purposes.

The boom arm 28 may also be telescopic in one embodiment. Thus, the boom arm 28 may include an outer arm portion 66 and an inner arm portion 68 that extends from an end 69 of the outer arm portion 66. The boom arm 28 may thus extend, then retract, and then extend again in order to retain the same vertical position when installing the vertical column 60 into the ground. The boom arm 28 may thus be extended in the raised position (shown in FIG. 9*a*), then may retract as the boom arm 28 approaches the middle position (shown in FIG. 9*b*), and then may again extend when lowering the boom arm 28 beyond the middle position to the lowered position (shown in FIG. 9*c*). The extension and retraction of the boom arm 28 may also serve other purposes during the vertical column installation process.

The boom arm 28 may be configurable to apply a constant downward pressure into the ground 62 when installing the vertical column 60 attached to the first end 58. This constant downward pressure may be a preset pressure set by a user. The pressure may be increasable or decreasable during the installation of the vertical column 60 as disclosed herein. For example, the constant downward pressure may be set to 500 lbs. Furthermore, the pressure may be preset such that it is lower than the amount of pressure that will cause the loader vehicle 10 to be lifted from the ground by the boom arm 28. This constant downward pressure may help to achieve a consistent installation speed, and promote the safety of the installation. Furthermore, the constant pressure allows an installer to not have to control the loader arms 24, 26 during installation as the pile 60 is installed into the ground 62. The pressure also helps the helical end 64 to bite into the ground 62 so it does more than simply dig a hole in the ground 62.

Referring to FIG. 3, the loader vehicle 10 is shown being operated to install the vertical column 60 into the ground 62. The loader vehicle 10 may be driven by an operator close to the correct position to install the vertical column 60. Then, the operator may be able to control the boom arm 28 to move into the exact proper position to install the vertical column 60. In order to control the boom arm 28, the loader vehicle 10 may also include a controller 70 in operable communication with the loader vehicle 10. The controller 70 may be configured to control movement of the attached boom arm 28.

Figure 4:
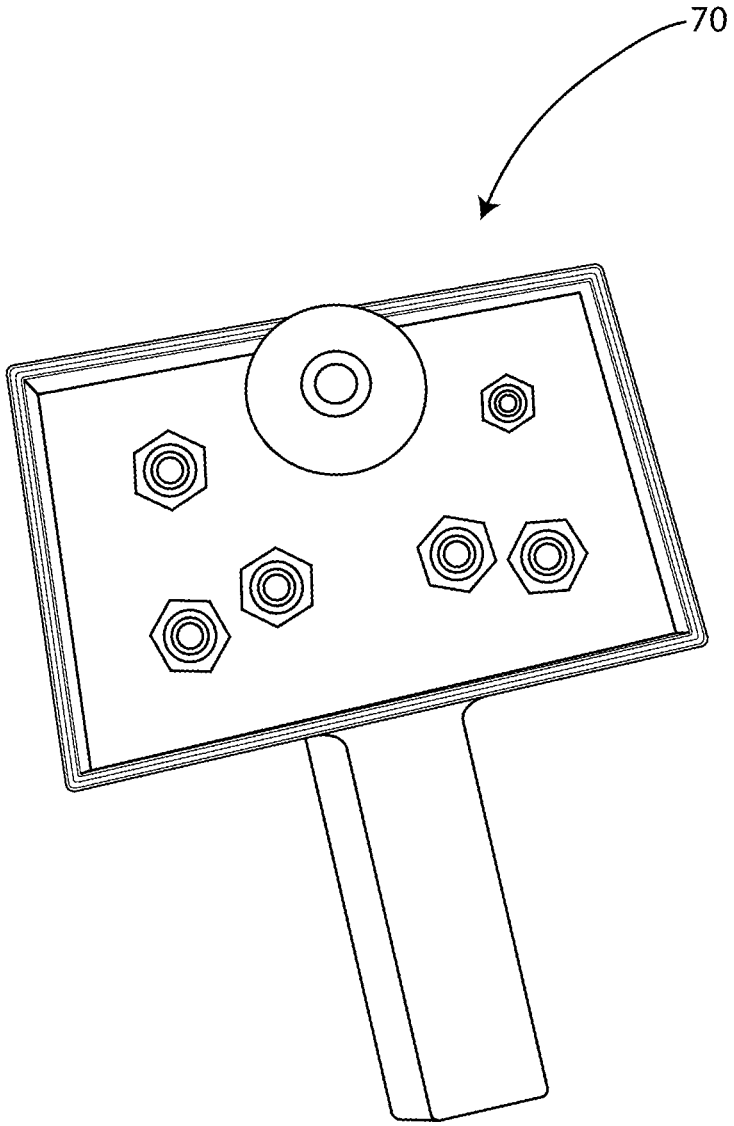
FIG. 4 depicts a perspective view of a controller of the loader vehicle of FIGS. 1-3 being held by the operator.
Figure 5:
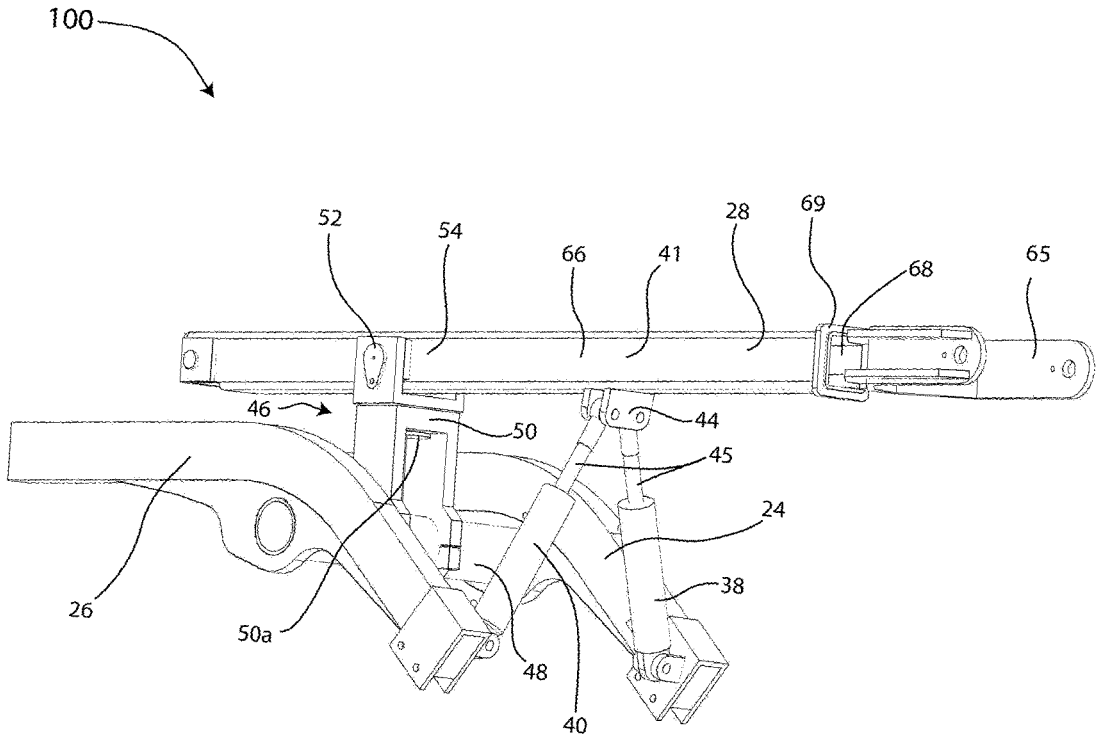
FIG. 5 depicts a perspective view of an attachment for a loader vehicle prior to being integrated in the loader.
Figure 6:
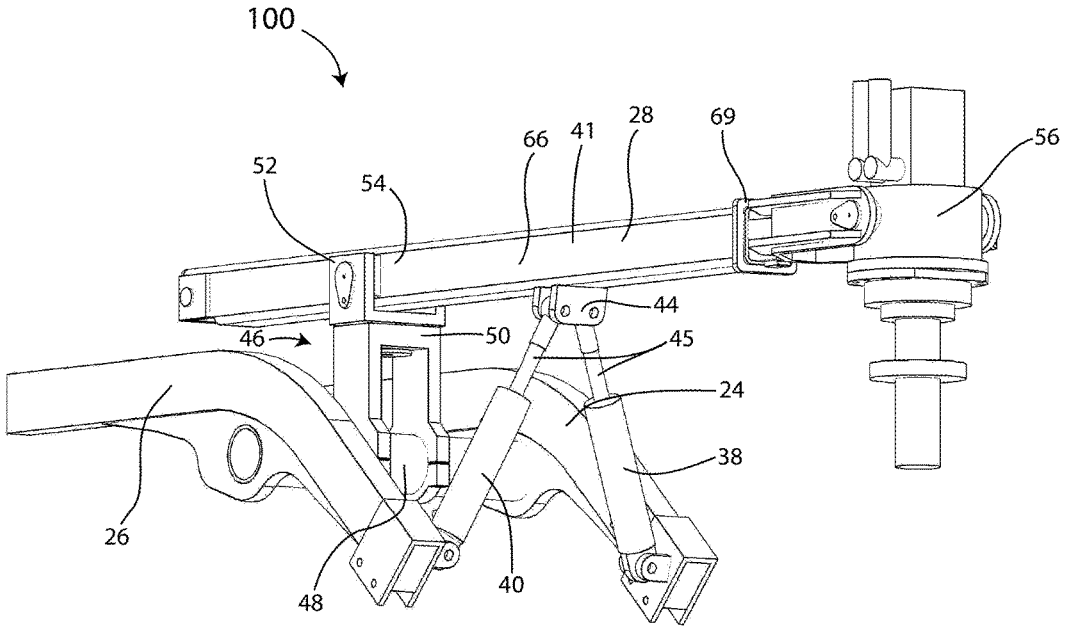
FIG. 6 depicts a perspective view of the attachment of FIG. 5 with a rotating mechanism attached at first end of a boom arm according to one embodiment.

The controller 70 is specifically shown in FIG. 4. The controller 70 may include a number of toggles or buttons in order to control the various movements of the loader vehicle 10 and the boom arm 28. For example, the controller 70 may allow an operator to control the raising and lowering of the loader arms 24, 26 by the hydraulic cylinders 34, 36. The controller 70 may also control the left and right motion of the boom arm 28 by the hydraulic cylinders 38, 40. The controller 70 may also control the telescoping of the boom arm 28. Still further, the controller 70 may control the rotation of the rotating mechanism 56. Moreover, the controller 70 may include a toggle to add the predetermined downward pressure on the vertical column 60. The controller 70 may also have an emergency button which may be configured to shut down all hydraulic functions and shut down the engine of the loader vehicle 10. The controller 70 may be movable a distance from the loader vehicle 10 while in use. In one embodiment, the controller 70 may be standing at or near the vertical column 60 to help guide it into the ground 62. This may free an operator from being required to control movements of the loader vehicle 10 and boom arm 28 from the operator position 18. Thus, only a single operator may be necessary. In another embodiment, a second operator (not shown) may be used that may help to operate the attachment at a distance from the loader 10, as shown in FIG. 3. In one embodiment, the controller 70 may be attached to the loader vehicle 10 with a wire as shown. In another embodiment, the controller 70 may communicate wirelessly (not shown) with the loader vehicle 10.

Referring now to FIGS. 5-9, in one embodiment, an attachment device 100 for the loader vehicle 10 is contemplated. Thus, a factory built standard loader vehicle that includes a dump bucket, for example, may be modified by removing the dump bucket arms and dump bucket, and attaching the attachment device 100 for installation of vertical columns. Thus, it is contemplated that the various features and embodiments described herein can be applicable to any type of bulldozer, tractor, excavator, bucket loader, front loader, front end loader, payloader, scoop loader, shovel, skip loader, wheel loader and the like.

Further contemplated herein is a method of installing vertical columns or piles, such as the vertical column 60. The method may first include providing a vertical loader vehicle or attachment for a vertical loader vehicle, such as the loader vehicle 10 or the attachment 100. The method may then include attaching a vertical column to the end of a boom arm, such as the boom arm 28. The method may then include rotating the boom arm with hydraulic cylinders, such as the hydraulic cylinders 38, 40. The method may further include applying a constant downward pressure on the vertical column by the boom arm. Moreover, the method may include moving the boom arm in an arc to the left and right with the hydraulic cylinders. The method may further include telescoping the boom arm for expansion and contraction. The method may further include remotely controlling the boom arm with a controller such as the controller 70.

Elements of the embodiments have been introduced with either the articles "a" or "an." The articles are intended to mean that there are one or more of the elements. The terms "including" and "having" and their derivatives are intended to be inclusive such that there may be additional elements other than the elements listed. The conjunction "or" when used with a list of at least two terms is intended to mean any term or combination of terms. The terms "first" and "second" are used to distinguish elements and are not used to denote a particular order.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

I claim:

1. An attachment for a loader vehicle comprising:

a left loader arm attachable to the loader vehicle;

a right loader arm attachable to the loader vehicle such that the left and the right loader arms are raisable and lowerable with respect to the loader vehicle in unison;

a boom arm operatively attached to the left loader arm and the right loader arm, wherein the boom arm extends in the same or substantially the same direction that at least a portion of both the left loader arm and the right loader arm extends, wherein the boom arm is positioned between the left loader arm and the right loader arm, and wherein the boom arm includes a rotating mechanism at a first end for attaching and rotating a vertical column for installation in the ground;

a first hydraulic cylinder pivotally attached to the left loader arm and the boom arm at a first midpoint location along a length of the boom arm;

a second hydraulic cylinder pivotally attached to the right loader arm and the boom arm at the first midpoint location along a length of the boom arm; and a base portion extending between the left loader arm and the right loader arm, wherein the boom arm is swivelably and tiltably attached to the base portion at a second midpoint location along a length of the boom arm;

wherein the first hydraulic cylinder pivots about the left loader arm and the second hydraulic cylinder pivots about the right loader arm to exact both swiveling rotation, wherein the first end of the boom arm rotates left and right towards the left loader arm and the right loader arm respectively, and tilting rotation, wherein the boom arm rotates up and down on the boom arm about the base mount, wherein the swiveling rotation and the tilting rotation occur simultaneously to move the first end of the boom arm in an arc, and wherein the first and second hydraulic cylinders extend at least substantially perpendicular to the boom arm and at least substantially perpendicular upwards from the ground when the attachment for the loader vehicle is attached to the loader vehicle.

2. The attachment for the loader vehicle of claim 1, wherein the first and second hydraulic cylinders are configured to exact rotation on the boom arm by moving the first end in a left direction to a leftmost position and also moving the first end in a right direction to a rightmost position, wherein the first hydraulic cylinder extends and the second hydraulic cylinder retracts when the first end of the boom arm is moved in the left direction, and wherein the first hydraulic cylinder retracts and the second hydraulic cylinder extends when the first end of the boom arm is moved in the right direction.

3. The attachment for the loader vehicle of claim 2, wherein the boom arm moves in an arc over the ground such that the boom arm is closest to the ground in the leftmost and rightmost positions, and farthest from the ground in a midpoint position between the leftmost and rightmost positions.

4. The attachment for the loader vehicle of claim 1, wherein the left loader arm and the right loader arm are configured to raise and fall simultaneously to lift and lower the boom arm.

5. The attachment for the loader vehicle of claim 1, further comprising a controller in operable communication with the loader vehicle configured to control movement of the attachment, wherein the controller is movable a distance from the loader vehicle while in use such that an operator can operate the attachment at the distance from the loader.

6. The attachment for the loader vehicle of claim 1, wherein the boom arm is configured to apply a constant downward pressure into the ground when installing the vertical column attached to the first end, and wherein the constant downward pressure is a preset pressure.

7. The attachment for the loader vehicle of claim 1, wherein the first hydraulic cylinder is attached to an end of the left loader arm and extends to a first location along the length of the boom arm, wherein the second hydraulic cylinder is attached to an end of the right loader arm and extends to the first location along the length of the boom arm.

8. The attachment for the loader vehicle of claim 1, wherein the rotating mechanism at the first end of the boom arm is attached to the boom arm by a mechanism that is rotatable on two axis.

9. An attachment for a loader vehicle comprising:

a left loader arm attachable to the loader vehicle;

a right loader arm attachable to the loader vehicle such that the left and the right loader arms are raisable and lowerable with respect to the loader vehicle in unison;

a first hydraulic cylinder pivotally attached to the left loader arm;

a second hydraulic cylinder pivotally attached to the right loader arm; and a base portion extending between the left loader arm and the right loader arm;

a boom arm attached to the first and second hydraulic cylinders at a first midpoint location along a length of the boom arm, the boom arm swivelably and tiltably attached to the base portion at a second midpoint location along the length of the boom arm, wherein the boom arm extends in the same or substantially the same direction that at least a portion of the left and right loader arms extend at a midpoint position, wherein the boom arm is positioned between the left loader arm and the right loader arm at the midpoint position, and wherein the first hydraulic cylinder pivots about the left loader arm and the second hydraulic cylinder pivots about the right loader arm to cause the boom arm to rotate about the left and right loader arms such that an end of the boom arm travels in an arc such that the boom arm both swivels and tilts simultaneously about the base portion at the second location.

10. A modified loader vehicle comprising:

a main body;

a left loader arm attached to the main body;

a right loader arm attached to the main body, the left and right loader arms configured to be raised and lowered in unison with respect to the main body;

a boom arm operatively attached to the left loader arm and the right loader arm, wherein the boom arm extends in the same or substantially the same direction that at least a portion of both the left loader arm and the right loader arm extends at a midpoint position, wherein the boom arm is positioned between the left loader arm and the right loader arm at the midpoint position, and wherein the boom arm includes a rotating mechanism at a first end for attaching and rotating a vertical column for installation in the ground;

a first hydraulic cylinder pivotally attached to the left loader arm, the first hydraulic cylinder pivotally attached to the boom arm at a first midpoint location along a length of the boom arm; and a second hydraulic cylinder pivotally attached to the right loader arm, the second hydraulic cylinder pivotally attached to the boom arm at the first midpoint location;

a base portion extending between the left loader arm and the right loader arm, wherein the boom arm is swivelably and tiltably attached to the base portion at a second midpoint location along the length of the boom arm;

wherein the first hydraulic cylinder pivots about the left loader arm and the second hydraulic cylinder pivots about the right loader arm to exact both swiveling and tilting rotation simultaneously on the boom arm about the base portion at the second position such that the first end travels in an arc with respect to the main body.

11. The loader vehicle of claim 10, wherein the first and second hydraulic cylinders are configured to exact rotation on the boom arm by moving the first end in a left direction to a leftmost position and also moving the first end in a right direction to a rightmost position, wherein the first hydraulic cylinder extends and the second hydraulic cylinder retracts when the first end of the boom arm is moved in the left direction, and wherein the first hydraulic cylinder retracts and the second hydraulic cylinder extends when the first end of the boom arm is moved in the right direction.

12. The loader vehicle of claim 11, wherein the boom arm moves in an arc over the ground such that the boom arm is closest to the ground in the leftmost and rightmost positions, and farthest from the ground in a midpoint position between the leftmost and rightmost positions.

13. The loader vehicle of claim 10, wherein the left loader arm and the right loader arm are configured to raise and fall simultaneously to lift and lower the boom arm.

14. The loader vehicle of claim 10, further comprising a controller in operable communication with the loader vehicle configured to control movement of the attachment, wherein the controller is movable the distance from the loader vehicle while in use such that an operator can operate the attachment at a distance from the loader.

15. The loader vehicle of claim 14, wherein the boom arm is configured to apply a constant downward pressure into the ground when installing the vertical column attached to the first end, and wherein the constant downward pressure is a preset pressure.

16. The loader vehicle of claim 10, wherein the rotating mechanism at the first end of the boom arm is attached to the boom arm by a mechanism that is rotatable on two axis.

17. The loader vehicle of claim 10, wherein the first and second hydraulic cylinders extend at least substantially perpendicular to the plane of rotation of the boom arm.

* * * * *